US005236521A

United States Patent [19]

Shikanai et al.

[11] Patent Number: 5,236,521

[45] Date of Patent: Aug. 17, 1993

[54] ABRASION RESISTANT STEEL

[75] Inventors: Nobuo Shikanai; Tetsuya Sanpei; Kazunori Yako; Kenji Hirabe; Yasunobu Kunisada, all of Kawasaki, Japan

[73] Assignee: NKK Corporation, Tokyo, Japan

[21] Appl. No.: 899,105

[22] Filed: Jun. 15, 1992

Related U.S. Application Data

[63] Continuation of Ser. No. 621,587, Dec. 3, 1990, abandoned.

[30] Foreign Application Priority Data

Jun. 6, 1990 [JP] Japan ..... 2-148400

[51] Int. Cl.[5] ..... C22C 38/14

[52] U.S. Cl. ..... 148/328; 420/126

[58] Field of Search ..... 148/328; 420/126

[56] References Cited

U.S. PATENT DOCUMENTS

| | | | |
|---|---|---|---|
| 2,905,577 | 9/1959 | Harris et al. | 420/126 |
| 4,075,041 | 2/1978 | Ueno et al. | 420/126 |
| 4,328,032 | 5/1982 | Mancini et al. | 420/126 |
| 4,826,543 | 5/1989 | Yano et al. | 148/12 F |
| 4,946,516 | 8/1990 | Yano et al. | 148/12 F |

FOREIGN PATENT DOCUMENTS

| | | | |
|---|---|---|---|
| 0523801 | 2/1956 | Belgium | 420/126 |
| 647987 | 5/1964 | Belgium | 420/126 |
| 0231864 | 8/1987 | European Pat. Off. . | |
| 861706 | 1/1951 | Fed. Rep. of Germany . | |
| 917674 | 9/1954 | Fed. Rep. of Germany . | |
| 945150 | 7/1956 | Fed. Rep. of Germany | 420/126 |
| 1483210 | 3/1969 | Fed. Rep. of Germany . | |
| 2408721 | 10/1974 | Fed. Rep. of Germany | 420/126 |
| 47-3383 | 1/1972 | Japan . | |
| 52-13418 | 2/1977 | Japan | 420/126 |
| 54-38571 | 11/1979 | Japan | 420/126 |
| 57-051243 | 3/1982 | Japan . | |
| 59-185760 | 10/1984 | Japan . | |
| 60-245768 | 12/1985 | Japan . | |

(List continued on next page.)

OTHER PUBLICATIONS

Stahl und Eisen, vol. 104, No. 22, Oct. 29, 1984, Dusseldorf DE pp. 1176–1184; Bechet et al.: "Verschleissbestandige Bleche", pp. 1182–1183; tables 1, 2: Steel Usirac 320; VSS 10 and Armco SSS.

Patent Abstracts of Japan, vol. 11, No. 369 (C-461)(2816) Dec. 2, 1987 of JP-A-62 142 726 (Kobe Steel).

Patent Abstracts of Japan, vol. 12, No. 446 (C-546)(3293) Nov. 24, 1988 of JP-A-63 169 359 (Sumitomo Metal).

Patent Abstracts of Japan, vol. 13, No. 399 (C-632)(3747) Sep. 5, 1989 of JP-A-1 142 023 (Kobe Steel) Jun. 2, 1989.

World Patents Index, Week 7130, Derwent Publications Ltd., London, GB; AN 71-50199S of JP-B-46 026 212 (Sumitomo Metal) 1971.

Patent Abstracts of Japan, vol. 6, No. 174(C-123)(1052) Sep. 8, 1982 of JP-A-57 089 426 (Shin Nippon Seitetsu).

Patent Abstracts of Japan, vol. 12, No. 312(C-523) Aug. 24, 1988 of JP-A-63 083 225 (Kawasaki Steel).

Patent Abstracts of Japan, vol. 11, No. 273 (C-445) Sep. 4, 1987 of JP-A-62 077 416 (Kawasaki Steel).

*Primary Examiner*—Deborah Yee

*Attorney, Agent, or Firm*—Frishaus, Holtz, Goodman & Woodward

[57] ABSTRACT

An abrasion resistant steel consisting essentially of 0.05 to 0.45 wt. % C, 0.1 to 1 wt. % Si, 0.1 to 2 wt. % Mn, 0.3 to 1.5 wt. % Ti, at most 0.005 wt. % N and the balance Fe as the basic elements contributing to the enhancement of the abrasion resistance property, without excessively increasing the hardness of the steel. In addition to the basic elements, at least one element selected from the group consisting of 0.1 to 2 wt. % Cu, 0.1 to 10 wt. % Ni, 0.1 to 3 wt. % Cr, 0.1 to 3 wt. % Mo and 0.0003 to 0.01 wt. % B may be added to enhance the quenching hardenability of the steel, and 0.01 to 0.5 wt. % V may be added to enhance the precipitation hardenability of the steel.

12 Claims, 1 Drawing Sheet

FOREIGN PATENT DOCUMENTS

| | | | |
|---|---|---|---|
| 61-079745 | 4/1986 | Japan . | |
| 61-117245 | 6/1986 | Japan . | |
| 61-221354 | 10/1986 | Japan . | |
| 61-238940 | 10/1986 | Japan . | |
| 1-142023 | 7/1988 | Japan . | |
| 62-142726 | 7/1988 | Japan . | |
| 63-169359 | 7/1988 | Japan . | |
| 2-194115 | 7/1990 | Japan . | |
| 2-220735 | 9/1990 | Japan . | |
| 3-202422 | 9/1991 | Japan . | |
| 377540 | 6/1964 | Switzerland . | |
| 168323 | 11/1965 | U.S.S.R. . | |
| 272564 | 6/1970 | U.S.S.R. | 420/126 |
| 271807 | 5/1972 | U.S.S.R. . | |
| 441336 | 5/1973 | U.S.S.R. . | |
| 982955 | 2/1965 | United Kingdom . | |
| 1060605 | 3/1967 | United Kingdom . | |
| 1176855 | 1/1970 | United Kingdom . | |
| 1235220 | 6/1971 | United Kingdom . | |
| 1248434 | 10/1971 | United Kingdom . | |
| 1253552 | 11/1971 | United Kingdom . | |
| 1253739 | 11/1971 | United Kingdom . | |
| 1338285 | 11/1973 | United Kingdom . | |
| 1218927 | 11/1979 | United Kingdom . | |
| 2122644 | 1/1984 | United Kingdom . | |
| 2244718 | 12/1991 | United Kingdom . | |

ABRASION RESISTANT STEEL

This application is a continuation of application Ser. No. 07/621,587, filed Dec. 3, 1990, now abandoned.

BACKGROUND OF THE INVENTION

1. Field of the Invention

The invention relates to the field of metallurgy and particularly relates to the field of an abrasion resistant steel utilized in the field of construction, civil engineering and mining.

2. Description of the Related Art

Abrasion resistant steels are utilized in the field of construction, civil engineering and mining such as in power shovels bulldozers, hoppers and buckets to maintain the lives of these machines or their parts. It is well known that the steel having a high hardness possesses high abrasion resistance property. For this purpose a high alloyed steel treated by quenching has commonly been utilized.

Japanese Patent laid open Publication Nos. 142726/19 87, 169359/1988 and 142023/1989 disclose information about the production of the conventional abrasion resistant steel. In these publications the Brinell Hardness of the steel is more than 300. The improvements of these publications, which are aimed at the weldability, the toughness and the workability in bending, and the abrasion resistance property, is realized by increasing the hardness of the steel.

However the property required for abrasion resistant steel has recently become severer and the essential solution to higher abrasion resistance of steel will not be obtained by simply enhancing the hardness of steel. When the hardness of steel is significantly enhanced, the weldability and the workability of steel are deteriorated due to the high alloying and the cost of producing such steels increases significantly. Accordingly in a practical point of view a significant increase in the hardness of abrasion resistant steel faces a difficulty with respect to the workability of the steel.

SUMMARY OF THE INVENTION

It is an object of the invention to provide an abrasion resistant steel.

It is an object of the invention to provide an abrasion resistant steel having an excellent abrasion resistance property without considerably increasing the hardness of steel. According to the invention an abrasion resistant steel is provided with approximately 0.05 to 0.45 wt. % C, 0.1 to 1.0 wt. % Si, 0.1 to 2.0 wt. % Mn, 0.05 to 1.5 wt. % Ti and the balance Fe as the basic elements contributing to the enhancement of the abrasion resistance property.

In addition to the basic elements, at least one element selected from the group consisting of 0.1 to 2.0 wt. % Cu, 0.1 to 10.0 wt. % Ni, 0.1 to 3.0 wt. % Cr, 0.1 to 3.0 wt. % Mo and 0.0003 to 0.01 wt. % B may be added to enhance the quenching hardenability of the steel, and at least one element selected from the group consisting of 0.005 to 0.5 wt. % Nb, 0.01 to 0.5 wt. % V may be added to enhance the precipitation hardenability of the steel.

A more preferable range aiming at the economy of the steel is 0.05 to 0.3 wt. % in Ti content. A more preferable range with respect to thr balance of the stable abrasion resistance and the economy of the steel is 0.3 to 1.0 wt. % in Ti content. A more preferable range for stable abrasion resistance is 1.0 to 1.5 wt. % in Ti content.

A more preferable range aiming at the bending workability and the weldability of the steel is 0.05 to 0.2 wt. % in C content. A more preferable range with respect to the balance of the bending workability and the weldability of the steel and the stable abrasion resistance of the steel is 0.2 to 0.35 wt. % in C content. A more preferable range for the stable abrasion resistance of steel is 0.35 to 0.45 wt. % in C content.

DESCRIPTION OF THE PREFERRED EMBODIMENT

Figure 1:
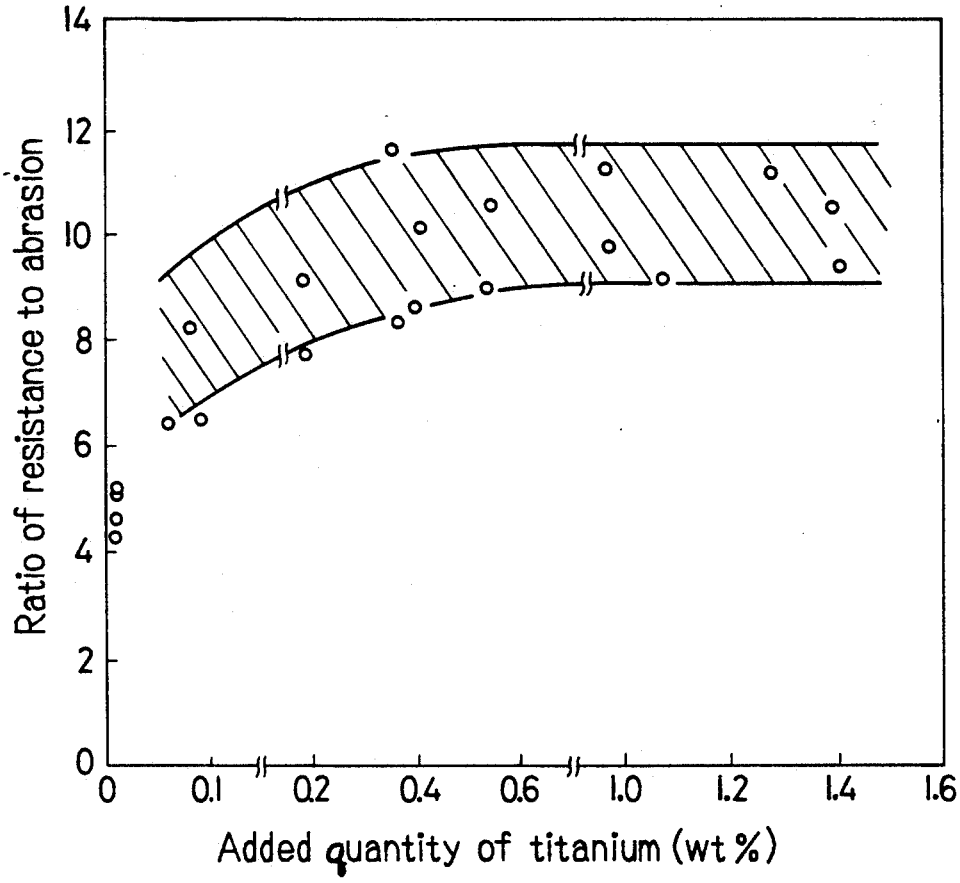
FIG. 1 is a graph showing the relationship between the added quantity of titanium and the ratio of resistance to abrasion.

The most significant characteristic of the invented steel is effectively utilizing very hard TiC. In this invention it is not necessary to enhance the hardness of the abrasion resistant steel only by transforming the microstructure of the steel to a martensite which is the conventional way to enhance the abrasion resistance of steel.

In the conventional way the purpose of the addition of titanium to steel is to cause a reaction with nitrogen so that the nitrogen is stabilized as TiN. As the result boron does not react with nitrogen since there is not enough nitrogen in the steel, and retained in the steel as a soluble boron, which enhances the quenching hardenability. The quantity of the addition in this case is about 0.02 wt. % of steel. The addition of a large quantity of titanium to steel is limited by the oxidation of the titanium in the steel melting stage, the clogging of the nozzle and the reaction with the oxidation preventing powder in the casting stage. Therefore the effect of the addition of a large quantity of titanium is not yet known.

The inventors after detailed examination found that the addition of titanium in a large quantity realizes the improvement of steel with respect to the abrasion resistance property.

FIG. 1 is a graph showing the relationship between the added quantity of titanium and the ratio of resistance to abrasion. The abscissa denotes the added quantity of titanium and the ordinate denotes the ratio of resistance to abrasion.

The ratio of resistance to abrasion is an index wherein the resistance to abrasion of an abrasion resistant steel is devided by that of a mild steel. The resistance to abrasion is measured according to ASTM Standard G 65-85 wherein an abrasive is introduced between the test specimen and a rotating wheel with a chlorobutyl rubber tire. The abrasive is a sand composed of 100% silica and of a controlled size. The C content of the test specimen is 0.3 wt. % and the specimen is heat treated by quenching. The Brinell Hardness is below 500. As shown in FIG. 1, the ratio of resistance to abrasion linearly increases with the increase of the added quantity of titanium up to 0.5 wt. %. The addition of titanium is effective when the added quantity of titanium is 0.05 wt. %. When the added quantity is 1.5 wt. %, the ratio of resistance to abrasion reaches about 10, which shows the remarkable improvement in the abrasion resistance property.

The following are the reasons why the contents of the elements of the invented steel is specified.

C is an indispensable element in forming TiC and also enhances the hardness of the matrix of steel. However when C is increased too much, the weldability and the workability are deteriorated. Therefore the upper limit of C is determined to be 0.45 wt. %. As for the lower limit of C the minimum quantity of C wherein the effect of TiC is shown is 0.05 wt. %.

A more preferable range aiming at the bending workability and the weldability of the steel is 0.05 to 0.2 wt. % in C content. A more preferable range with respect to the balance of the bending workability and the weldability of the steel and the stable abrasion resistance of the steel is 0.2 to 0.35 wt. % in C content. A more preferable range for the stable abrasion resistance of the steel is 0.35 to 0.45 wt. % in C content.

Si is an element effective in deoxidation process of steel making and a minimum addition of 0.1 wt. % is required for this purpose. Si is also an effective element for solution hardening. However when the Si content exceeds 1.0 wt. %, the toughness of steel is lowered and the inclusion in steel is increased. Therefore the Si content is determined to be 0.1 to 1.0 wt. %.

Mn is an element effective in quenching hardenability. At least 0.1 wt. % is required for this purpose. When the Mn content exceeds 2.0 wt. %, the weldability of steel is deteriorated. Therefore the Mn content is determined to be 0.1 to 2.0 wt. %.

In this invention Ti is one of the most important elements as is C. The addition of at least 0.05 wt. % of Ti is required to stably form a large quantity of TiC. When the Ti content exceeds 1.5 wt. %, the steel possesses good abrasion resistance property but high cost is required for the production, also the weldability and the workability of steel are lowered. Therefore the Ti content is required to be 0.05 to 1.5 wt. %.

A more preferable range aiming at the economy of the steel is 0.05 to 0.3 wt. % in Ti content. A more preferable range with respect to the balance of the stable abrasion resistance and the economy of the steel is 0.3 to 1.0 wt. % in Ti content. A more preferable range for stable abrasion resistance of the steel is 1.0 to 1.5 wt. % in Ti content.

In this invention, in addition to the above basic elements, at least one element selected from the group consisting of Cu, Ni, Cr, Mo and B may be added to enhance the quenching hardenability and at least one element selected from the group consisting of Nb and V may be added to enhanve the precipitation hardening.

Cu is an element for enhancing the quenching hardenability and effective in controlling the hardness of steel. When the Cu content is below 0.1 wt. %, the effect is not sufficient. When the Cu content exceeds 2.0 wt. %, the hot workability is lowered and the production cost is increased. Therefore the Cu content is determined to be 0.1 to 2.0 wt. %.

Ni is an element which enhances the quenching hardenability and the low temperature toughness. When the Ni content is below 0.1 wt. %, the effect is not sufficient. When the Ni content exceeds 10.0 wt. %, the production cost is increased significantly. Therefore the Ni content is determined to be 0.1 to 10.0 wt. %.

Cr is an element which enhances the quenching hardenability. When the Cr content is below 0.1 wt. %, the effect is not sufficient. When the Cr content exceeds 3.0 wt. %, the weldability is deteriorated, and the production cost is increased. Therefore the Cr content is determined to be 0.1 to 3.0 wt. %.

Mo is an element which enhances the quenching hardenability. When the Mo content is below 0.1 wt. %, the effect is not sufficient. When the Mo content exceeds 3.0 wt. %, the weldability is deteriorated, and the production cost is increased. Therefore the Mo content is determined to be 0.1 to 3.0 wt. %.

B is an element which enhances the quenching hardenability by the addition to steel even by a small amount. When the B content is below 0.0003 wt. %, the effect is not sufficient. When the B content exceeds 0.01 wt. %, the weldability is deteriorated, and the quenching hardenability is also deteriorated. Therefore the B content is determined to be 0.0003 to 0.01 wt. %.

Nb is an element effective in the precipitation hardening and can control the hardness of steel according to the purpose of steel. When the Nb content is below 0.005 wt. %, the effect is not sufficient. When the Nb content exceeds 0.5 wt. %, the weldability is deteriorated. Therefore the Nb content is determined to be 0.005 to 0.5 wt. %.

V is an element effective in the precipitation hardening and can control the hardness of steel according to the purpose of steel. When the V content is below 0.01 wt. %, the effect is not sufficient. When the V content exceeds 0.5 wt. %, the weldability is deteriorated. Therefore the V content is determined to be 0.01 to 0.5 wt. %.

In this invention no specification is required as for the method of working the steel and as for the method of heat treating of the steel. The invention may not be inoperable by heat treatments such as quenching, annealing, aging and stress relief annealing.

EXAMPLE

Table 1 shows the chemical compositions of the samples of the invented and conventional steel.

Samples from A to O are made of the invented steel, whereas samples from P to R are made of the steel for comparison. The chemical composition of the samples from P to R varies with respect to Ti and other alloying elements. The chemical compositions of the samples P and Q are within the same range with those of the invented steel except that of Ti. The chemical composition of the sample R is within the same range of the invented steel with respect to Ti, but out of the range with respect to C.

TABLE 1

| | C | Si | Mn | Cu | Ni | Cr | Mo | Nb | V | Ti | B | N |
|---|---|---|---|---|---|---|---|---|---|---|---|---|
| A | 0.30 | 0.36 | 0.70 | — | — | — | — | — | — | 0.09 | — | 33 |
| B | 0.28 | 0.37 | 0.73 | — | — | — | — | — | — | 0.37 | — | 38 |
| C | 0.29 | 0.37 | 0.74 | — | — | — | — | — | — | 0.98 | — | 36 |
| D | 0.29 | 0.36 | 0.71 | — | — | — | — | — | — | 1.41 | — | 30 |
| E | 0.28 | 0.36 | 0.71 | 0.24 | 0.29 | — | — | — | — | 0.40 | — | 31 |
| F | 0.31 | 0.33 | 0.73 | — | — | 1.02 | 0.23 | — | — | 1.08 | 10 | 32 |
| G | 0.19 | 0.33 | 1.44 | — | — | 0.27. | — | — | — | 0.65 | 9 | 22 |
| H | 0.14 | 0.34 | 1.40 | — | — | — | — | 0.025 | — | 0.40 | — | 24 |
| I | 0.32 | 0.34 | 0.72 | — | — | — | — | — | 0.045 | 0.41 | — | 21 |
| J | 0.34 | 0.26 | 1.01 | 0.35 | 0.55 | — | — | 0.028 | 0.041 | 0.54 | — | 42 |

TABLE 1-continued

| | C | Si | Mn | Cu | Ni | Cr | Mo | Nb | V | Ti | B | N |
|---|---|---|---|---|---|---|---|---|---|---|---|---|
| H | 0.31 | 0.38 | 0.71 | — | — | 0.99 | 0.23 | 0.022 | 0.044 | 0.06 | 8 | 24 |
| L | 0.29 | 0.38 | 0.70 | — | — | 0.99 | 0.23 | — | 0.044 | 0.08 | 9 | 23 |
| M | 0.30 | 0.36 | 0.71 | 0.25 | — | 0.55 | 0.23 | — | 0.045 | 0.19 | 8 | 30 |
| N | 0.31 | 0.36 | 0.71 | — | — | 1.02 | 0.23 | — | 0.045 | 0.38 | 8 | 31 |
| O | 0.31 | 0.33 | 0.73 | — | 0.36 | 0.63 | 0.34 | — | — | 1.28 | — | 32 |
| P | 0.30 | 0.30 | 0.75 | — | — | — | — | — | — | 0.02 | — | 37 |
| Q | 0.30 | 0.30 | 0.96 | — | — | 1.03 | 0.21 | — | 0.045 | 0.01 | 11 | 47 |
| R | 0.03 | 0.30 | 0.75 | — | — | — | — | — | — | 0.47 | — | 37 |

Note:
The values are in wt. % except for B and N. The values of B and N are in ppm.

TABLE 2

| | Process | Ratio of resistance to abrasion | Brinell Hardness (HB) |
|---|---|---|---|
| A | RQ | 6.5 | 474 |
| B-1 | RQ | 83. | 393 |
| B-2 | RQT (400° C.) | 6.1 | 277 |
| C-1 | DQ | 9.7 | 335 |
| C-2 | DQT (400° C.) | 6.8 | 245 |
| D | RQ | 9.3 | 242 |
| E | RQ | 8.6 | 390 |
| F | RQ | 9.1 | 321 |
| G | RQ | 4.7 | 302 |
| H | DQ | 3.4 | 253 |
| I | RQ | 10.1 | 451 |
| J | DQ | 8.9 | 417 |
| K | RQ | 6.4 | 503 |
| L-1 | AR | 4.5 | 293 |
| L-2 | DQ | 8.2 | 507 |
| M-1 | AR | 4.7 | 286 |
| M-2 | DQ | 9.1 | 454 |
| N-1 | AR | 6.1 | 274 |
| N-2 | RQ | 11.6 | 448 |
| O-1 | AR | 7.3 | 246 |
| O-2 | RQ | 11.1 | 275 |
| P | RQ | 4.9 | 464 |
| Q-1 | AR | 2.8 | 326 |
| Q-2 | RQ | 5.2 | 481 |
| R | RQ | 1.2 | 122 |

Table 2 shows the process of making the samples, the ratio of the resistance to abrasion and the Brinell Hardness of the samples. Samples from A to O are made of the invented steel, whereas samples from P to R are made of the steel for comparison.

The abrasion test is carried out according to ASTM G 65-85 as described before. The measurement of the abrasion is done by the change of the weight of the sample.

As described before the ratio of resistance to abrasion is the ratio of the weight change of the specimen made of the invented steel versus that of the specimen made of a mild steel.

The processes in the table are classified as follows; AR, as rolled; RQ, as quenched after heated to 900° C. following the rolling and air-cooling; RQT, as tempered at the temperature shown in the parenthesis after RQ treatment; DQ, as directly quenched after finish rolled at 880° C. following the heating of the slab at 1150° C.; DQT, as tempered at the temperature shown in the parenthesis following DQ. The thickness of the sample is 15 mm. The kind of steel in Table 1 corresponds with those in Table 2.

The steel for comparison P corresponds with the invented steel A, B-1 and D and the Ti content is below the range of the invented steel. Examining the ratio of the resistance to abrasion, it is found that the ratio is 4.9 in the steel for comparison P, whereas the ratio of the invented steel A is 6.5, that of the steel B-1, 8.3 and that of the steel D, 9.3. This is to say that the ratio of the invented steel can be enhanced twice as much as that of the steel for comparison which is a conventional abrasion resistant steel. Moreover the hardness of the invented steel is lower than those of the steel for comparison.

This result agrees with the purpose of the invention wherein the invented steel possesses high resistance to abrasion and low hardness.

The steel for comparison Q corresponds with the invented steel L and N. The ratios of the resistance to abrasion in both L and N are higher than that of Q.

The steel for comparison R corresponds with the invented steel B-1. The C content of the steel for comparison R is below the range of the invented steel. Since the C content of the steel R is so low that the ratio of the resistance to abrasion is significantly lower than that of B-1.

What is claimed is:

1. An abrasion resistant steel consisting essentially of: 0.2 to 0.35 wt. % C, 0.1 to 1 wt % Si, 0.1 to 2 wt % Mn, 0.3 to 1 wt % Ti, 0.0021 to 0.0042 wt. % N, and the balance being Fe and inevitable impurities, the abrasion resistant steel containing TiC and having a ratio of resistance to abrasion in the range from 6.1 to 11.6 when measured according to ASTM standard G65-85 and having a Brinell Hardness in the range from 245 to 451.

2. The abrasion resistant steel of claim 1, have been prepared by a process comprising hot-rolling, air-cooling, heating and quenching.

3. The abrasion resistant steel of claim 1, have been prepared by a process comprising heating, hot-rolling and direct-quenching.

4. An abrasion resistant steel consisting essentially of: 0.2 to 0.35 wt. % C, 0.1 to 1 wt. % Si, 0.1 to 2 wt. % Mn, 0.3 to 1 wt. % Ti, 0.0021 to 0.0042 wt. % N, at least one element selected from the group consisting of 0.1 to 2 wt. % Cu, 0.1 to 10 wt. % Ni, 0.1 to 3 wt. % Cr, 0.1 to 3 wt. % Mo and 0.0003 to 0.01 wt. % B, and the balance being Fe and inevitable impurities; and the abrasion resistant steel containing TiC and having a ratio of resistance to abrasion in the range from 6.1 to 11:6 when measured according to ASTM standard G65-85 and having a Brinell Hardness in the range from 274 to 448.

5. The abrasion resistant steel of claim 4, having been prepared by a process comprising hot-rolling, air-cooling, heating and quenching.

6. An abrasion resistant steel consisting essentially of: 0.2 to 0.35 wt % C, 0.1 to 1 wt % Si, 0.1 to 2 wt % Mn, 0.3 to 1 wt % Ti, 0.0021 to 0.0042 wt. % N, at least one element selected from the group consisting of 0.005 to 0.5 wt % Nb and 0.01 to 0.5 wt %

V, and the balance being Fe and inevitable impurities; and the abrasion resistant steel containing TiC and having a ratio of resistance to abrasion in the range from 6.1 to 11.6 when measured according to ASTM standard G65-85 and having a Brinell Hardness in the range from 274 to 451.

7. An abrasion resistant steel consisting essentially of: 0.2 to 0.35 wt % C, 0.1 to 1 wt % Si, 0.1 to 2 wt % Mn, 0.3 to 1 wt % Ti, 0.0021 to 0.0042 wt. % N, at least one element selected from the group consisting of 0.1 to 2 wt % Cu, 0.1 to 10 wt % Ni, 0.1 to 3 wt % Cr, 0.1 to 3 wt % Mo and 0.0003 to 0.01 wt % B, 0.005 to 0.5 wt % Nb and 0.01 to 0.5 wt % V, and the balance being Fe and inevitable impurities; and the abrasion resistant steel containing TiC and having a ratio of resistance to abrasion in the range from 6.1 to 11.6 when measured according to ASTM standard G65-85 and having a Brinell Hardness in the range from 274 to 451.

8. The abrasion resistant steel of claim 7, having been prepared by a process comprising hot-rolling, air-cooling, heating and quenching.

9. The abrasion resistant steel of claim 7, having been prepared by a process comprising heating, hot-rolling and direct-quenching.

10. The abrasion resistant steel of claim 1, wherein the abrasion resistant steel has a ratio of resistance to abrasion in the range from 6.1 to 9.7 when measured according to ASTM standard G65-85.

11. The abrasion resistant steel of claim 7, wherein the C is an amount of 0.29 to 0.34 wt. %.

12. The abrasion resistant steel of claim 7, wherein the Ti is in an amount of 0.3 to 0.54 wt. % and the C is in an amount of 0.29 to 0.34 wt. %.

* * * * *

UNITED STATES PATENT AND TRADEMARK OFFICE

CERTIFICATE OF CORRECTION

PATENT NO. : 5,236,521

DATED : August 17, 1993

INVENTOR(S) : SHIKANAI et al

It is certified that error appears in the above-identified patent and that said Letters Patent is hereby corrected as shown below:

Title Page, [56] References Cited, FOREIGN PATENT DOCUMENTS (Page 2), after "2244718...United Kingdom" insert
--1 253 740 11/1971 United Kingdom--.

Column 6, line 42 (Claim 2), delete "have" and insert --having--.

Column 6, line 45 (Claim 3), delete "have" and insert --having--.

Signed and Sealed this

Thirteenth Day of December, 1994

Bruce Lehman

*Attest:*

BRUCE LEHMAN

*Attesting Officer*

*Commissioner of Patents and Trademarks*